US006036529A

United States Patent [19]

Brown et al.

[11] Patent Number: 6,036,529

[45] Date of Patent: Mar. 14, 2000

[54] CONNECTOR ASSEMBLY WITH CABLE GUIDE

[75] Inventors: Michael Brown, Orleans; Ernest R. Dynie; Steven Rhodes, both of Nepean, all of Canada

[73] Assignee: Nortel Networks Corporation, Montreal, Canada

[21] Appl. No.: 09/161,432

[22] Filed: Sep. 24, 1998

[51] Int. Cl.[7] ..... H01R 13/56

[52] U.S. Cl. ..... 439/445; 439/446; 439/447

[58] Field of Search ..... 439/445, 446, 439/449

[56] References Cited

U.S. PATENT DOCUMENTS

| | | | |
|---|---|---|---|
| 3,009,129 | 11/1961 | Kirk, Jr. | 439/449 |
| 3,345,604 | 10/1967 | Henschen et al. | 439/310 |
| 4,367,967 | 1/1983 | Albert, Jr. | 403/41 |
| 4,678,867 | 7/1987 | Bongard et al. | 174/135 |
| 5,037,175 | 8/1991 | Weber | 385/76 |
| 5,315,062 | 5/1994 | Hoshino | 174/52 |
| 5,421,740 | 6/1995 | Dittburner et al. | 439/736 |
| 5,816,842 | 10/1998 | Thantrakul et al. | 439/374 |

OTHER PUBLICATIONS

IBM Technical Disclosure Bulletin, vol. 34 No. 1, pp. 150–151, Jun. 1991.

*Primary Examiner*—Paula Bradley
*Assistant Examiner*—Truc Nguyen

[57] ABSTRACT

A connector assembly for releasably interconnecting at least one cable connector connected to a respective cable to at least one module connector attached to a module. The connector assembly comprises a hollow body portion, a cable guide portion and a connector sub-assembly for mating with the cable connector and the module connector. The majority of the connector sub-assembly is placed inside the body portion. The cable guide portion is pivotally connected to the body portion of the connector assembly to permit movement of the cable guide portion between an open position in which access to manually mate or unmate the cable connector with the connector sub-assembly is provided and a closed position in which the cable guide portion prevents such access. The cable guide guides the respective cable and prevents breakage of the respective cable due to excessive bending.

22 Claims, 6 Drawing Sheets

CONNECTOR ASSEMBLY WITH CABLE GUIDE

FIELD OF INVENTION

This invention relates to connector assemblies.

BACKGROUND OF THE INVENTION

Telecommunications equipment or other electronic equipment is typically housed in frames or racks. In each frame, there are typically a plurality of shelves. Each shelf typically has a plurality of receiving stations, each with an open front end for receiving a respective module. Each receiving station typically has a rear with a rear mating connector connected to a backplane of the frame. Each rear mating connector is typically connected to at least one other rear mating connector via the backplane.

Each module typically houses electrical, electronic and/or optical equipment, such as telecommunications equipment. Each module typically has a rear connector at the rear of the module. The rear connector mates with the rear mating connector of the respective receiving station to provide a connection or connections through the backplane to at least one other module. At the front of each module, it is not uncommon for cable mating connectors to be provided for connection by cable connectors to cables extending to other modules in the same frame or in another frame or to other pieces of equipment located exterior to the frame.

However, the cable connectors for mating with the cable mating connectors on the front of the modules are vulnerable to damage either during use or during maintenance as in the later circumstance, the cable connectors tend to be left hanging loosely on their associated cables. Some types of cable connectors (e.g. fibre optic connectors) are more vulnerable to damage than others. Furthermore, many types of cables (such as fibre optic cable) are vulnerable to damage or breakage due to excessive bending. And finally, many types of cable connectors are small and difficult to handle when mating or disconnecting them with the cable mating connectors.

U.S. Pat. No. 5,421,740 (Dittburners et al.) granted on Jun. 6, 1995, discloses an electronic circuit pack and mounting frame combination in which a mating connector, joined to conductors coming in for connection to the circuit pack, is held within a connector holder for protection and connection purposes. The connector holder is attached to the frame to support the weight of the holder and minimize strain upon the incoming conductors especially when the conductor holder is disconnected from the circuit pack. However, if the conductors (or cables) break, the cable connectors with their respective conductors (or cables) cannot be easily removed (or replaced) from the connector holder.

SUMMARY OF THE INVENTION

It is an object of the present invention to provide a connector assembly in which the above mentioned problems are minimized or avoided.

In accordance with one aspect of the present invention, there is provided a connector assembly for releasably interconnecting at least one cable connector connected to a respective cable to at least one module connector attached to a module, the connector assembly comprising a body portion and a cable guide portion, wherein the body portion has a front end and an opposite second end and is provided with at least one module mating connector at the front end for mating with the at least one module connector and at least one cable mating connector at the second end for mating with the at least one cable connector, the module mating connector and the cable mating connector being mutually electrically interconnected and wherein the cable guide portion is disposed at the second end of the body portion and comprises a cable guide for guiding the respective cable of the cable connector in a predetermined direction, the cable guide portion being pivotally connected to the body portion to permit movement of the cable guide portion between an open position relative to the body portion in which open access to manually mate or unmate the cable connector with the cable mating connector is provided and a closed position relative to the body portion in which the cable guide prevents such access.

In accordance with another aspect of the present invention, there is provided a connector assembly for releasably interconnecting at least one cable connector connected to a respective cable to at least one module connector attached to a module, the connector assembly comprising a body portion and a cable guide portion, wherein the body portion has a front end and an opposite second end and is provided with at least one module mating connector at the front end for mating with the at least one module connector and at least one cable mating connector at the second end for mating with the at least one cable connector, the module mating connector and the cable mating connector being mutually electrically interconnected and wherein the cable guide portion is disposed at the second end of the body portion and comprises a cable guide for guiding the respective cable of the cable connector in a predetermined direction, the cable guide portion being connected to the body portion.

BRIEF DESCRIPTION OF THE DRAWINGS

A detailed description of preferred embodiments is provided below with reference to the following drawings, in which.

DETAILED DESCRIPTION OF THE PREFERRED EMBODIMENTS

Figure 1:
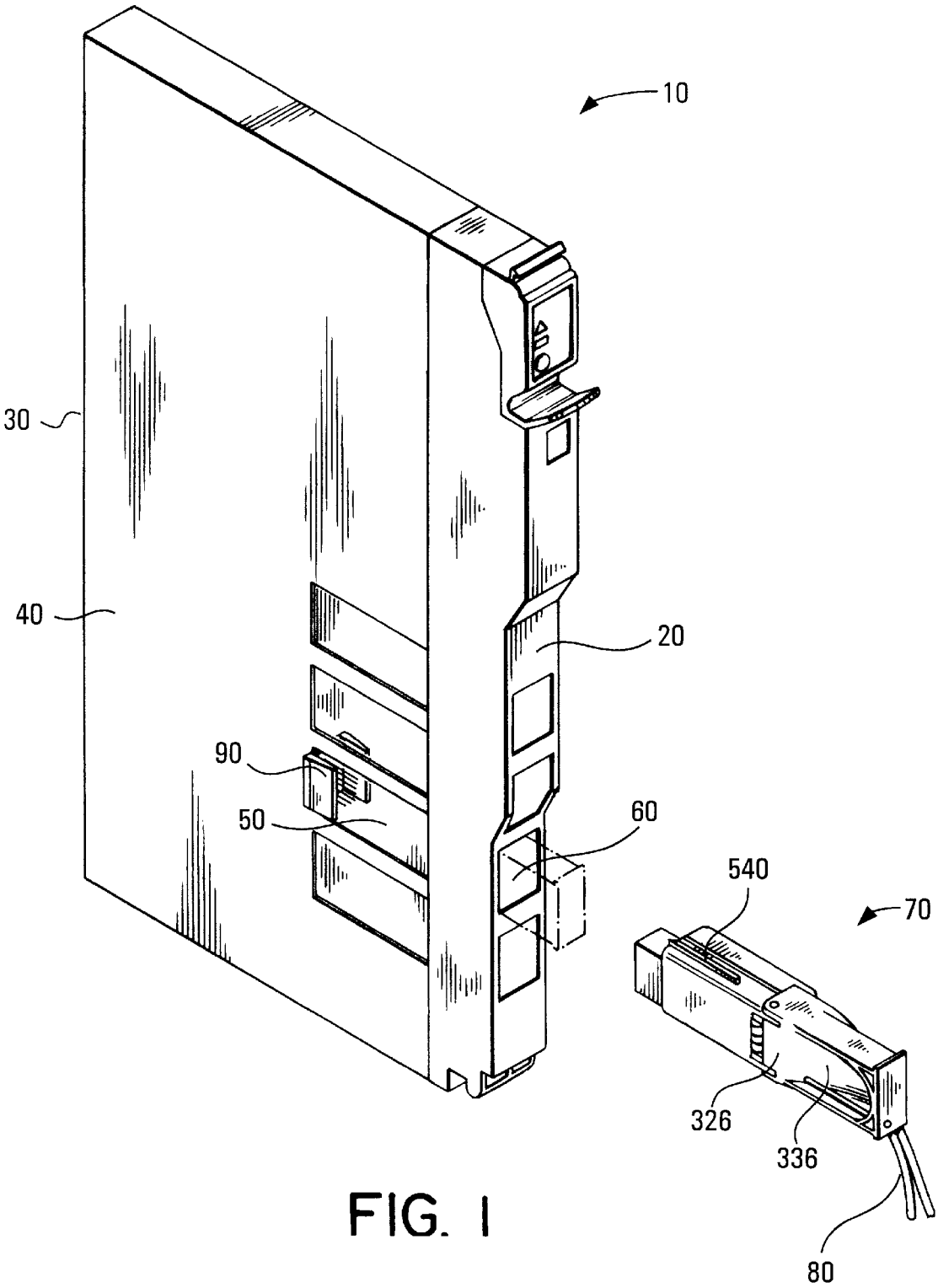
FIG. 1 is a perspective view of a module and a connector assembly according to a preferred embodiment of the present invention.

Referring to FIG. 1, a module 10 is formed as a slim rectangular housing having a front edge 20 used as a faceplate, a rear edge 30 and two flat sides 40. A plurality of openings 60 for receiving a plurality of connector assemblies 70 respectively is provided in the front edge 20. Connected to each connector assembly 70 is a pair of cables 80. The cables 80 are typically connected to another module or to other equipment. The type of cable used for the cables 80 depends on the application. The cables 80 may be a copper cable, a coaxial cable, a fibre optic cable, etc. FIG. 1 illustrates a fibre optic cable.

The module 10 houses electrical, electronic and/or optical equipment. A module connector 90 for mating with the connector assembly 70 is connected to the electrical, electronic and/or optical equipment and is housed inside a respective opening 60 at a location spaced back from the front edge 20.

The module 10 is typically placed within a receiving station of a shelf of a frame. (Not shown). A rear module connector (not shown) is typically attached to the rear edge 30 of the module 10. The rear module connector mates with a rear module mating connector (not shown) connected to a backplane (not shown) of the frame to provide a connection or connections to at least one other module or other equipment (not shown).

Referring to FIGS. 2, 3, 4 and 5, connected to each cable 80 is a respective cable connector 410. In the preferred embodiment, each cable connector 410 is a fibre optic cable connector. However, if other types of cable are used for cables 80, then other types of connectors can be used.

The connector assembly 70 comprises a hollow body portion 100 having a front end 102 and an opposite second end 104, a handle portion 110, a cable guide portion 125 attached to the handle portion 110 and a connector sub-assembly 130 having a rear end 132 and a front end 134. The majority of the connector sub-assembly 130 is placed inside the body portion 100. The cable guide portion 125 is pivotally connected to the body portion 100.

The cable guide portion 125 comprises a cable guide 310. The cable guide 310 prevents the excessive bending of the cables 80 and helps protect the cable connectors 410. (If the cables 80 are bent too much, the cables 80 may break or a portion of the cables 80 may break). The amount of bending that the cables 80 can tolerate depends on the type of cable used. For example, if fibre optic cable is used for the cables 80, the fibre optic cable must not typically have an arc with a radius less that three inches; otherwise, the fibre optic cable may break.

Figure 2:
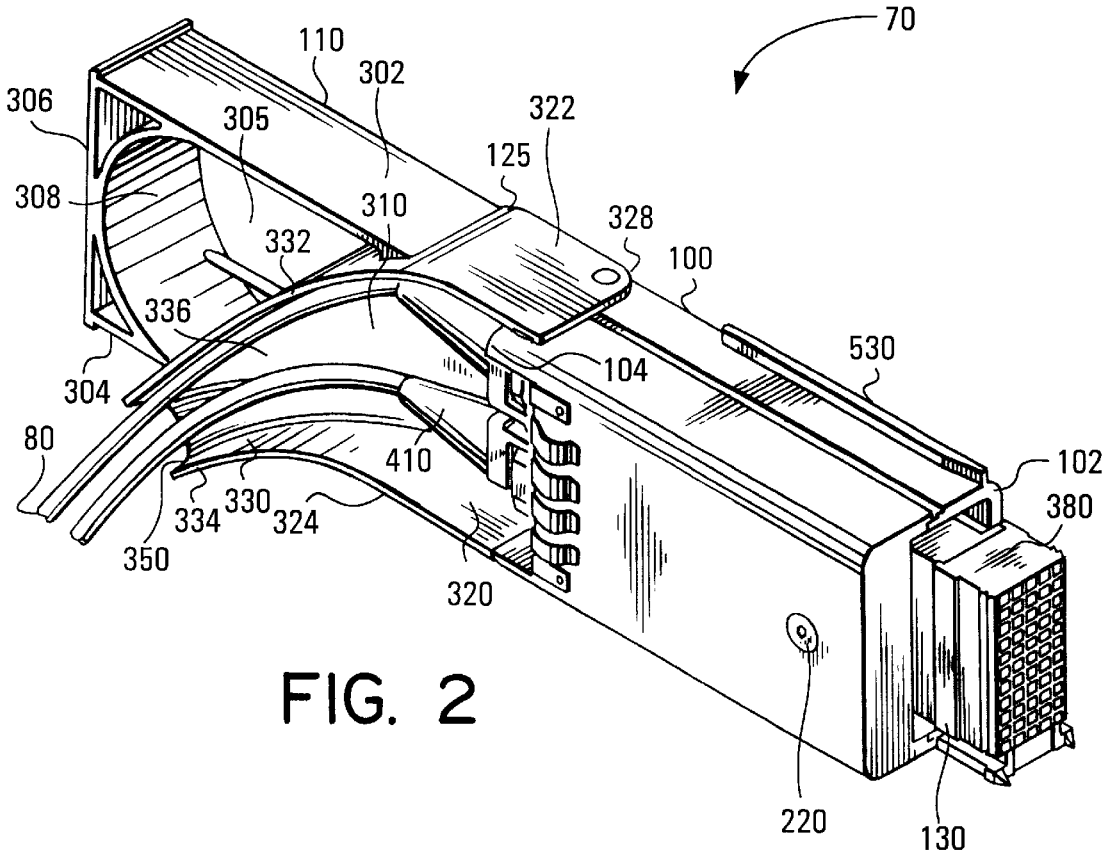
FIG. 2 is a perspective view, drawn to a larger scale, of the connector assembly, shown in FIG. 1, in which a cable guide portion is shown in a closed position and cable connectors are shown in a mated position.

As shown in FIG. 2, the cable guide 310 has an upper end 320 and a lower end 330. The upper end 320 has a front end 150, a top wall 322, a bottom wall 324, a back 326 and a front side 328. The top wall 322 and the bottom wall 324 are substantially parallel to each other and attached to the back 326. The lower end 330 has an outside, an inside, a curved top wall 332, a curved bottom wall 334 and a curved back 336. The curved top wall 332 and the curved bottom wall 334 are attached to the curved back 336. The curved top wall 332, the curved bottom wall 334 and the curved back 336 all converge toward a cable opening 350. In other words, the inside of the lower end 330 has a shape similar to the cross portion of a funnel with a curved lower portion terminating at a bottom opening. A cable divider 360 is attached to the inside of the lower end 330 of the cable guide 310. The cable divider 360 helps separate the cables 80. The arcs of the curved top wall 332, the curved bottom wall 334, and the curved back 336 each have a radius greater than a breakage radius for the type of cable used for the cables 80. The breakage radius is the radius at which the cables 80 will likely break or be damaged due to excessive bending. (e.g. three inches for fibre optic cable).

The handle portion 110 has a top wall 302, a bottom wall 304, a front outside wall 306, a front inside wall 308 attached to the front outside wall 306, to the top wall 302 and to the bottom wall 304 and an opening 305. The top wall 302 and the bottom wall 304 are substantially parallel to each other and are attached to the front outside wall 306 and to the front inside wall 308. The front outside wall is perpendicular to the top wall 302 and to the bottom wall 304. The front inside wall 308 is concave to provide a more comfortable surface for a finger of a user. A portion of the top wall 302 is attached to the curved top wall 332 near where the curved top wall 332 is attached to the upper end 320. A remaining portion of the top wall 302 is attached to the curved back wall 336. Similarly, a portion of the bottom wall 304 is attached to the curved top wall 332 near where the curved bottom wall 334 is attached to the upper end 320. A remaining portion of the bottom wall 304 is also attached to the curved back wall 336. The opening 305 is formed by the top wall 302, the front inside wall 308, the bottom wall 304, the curved top wall 332 and the curved back wall 336.

The body portion 100 typically comprises a first half 200 having an inside 202 and an outside 204, a second half 210 having an inside 212 and an outside 214 and attachment means to attach the first half 200 with the second half 210. The first half 200 has a front end 240, a rear end 242, a top 244, a bottom 246 and a side 248. Similarly, the second half 210 has a front end 250, a rear end 252, a top 254, a bottom 256 and a side 258. The second half 220 has a first ridge 232, a second ridge 234 and a third ridge 236, all of which typically run along the inside 212 of the side 258 from the top 254 to the bottom 256. The attachment means comprise a bolt 220 and a hollow cylinder with a plurality of complementary grooves 230 for mating with the bolt 220. The hollow cylinder with the complementary grooves 230 is attached to the inside 212 of the side 258 of the second half 210. The bolt 220 passes through a hole 222 in the side 248 of the first half 200.

Figure 3:
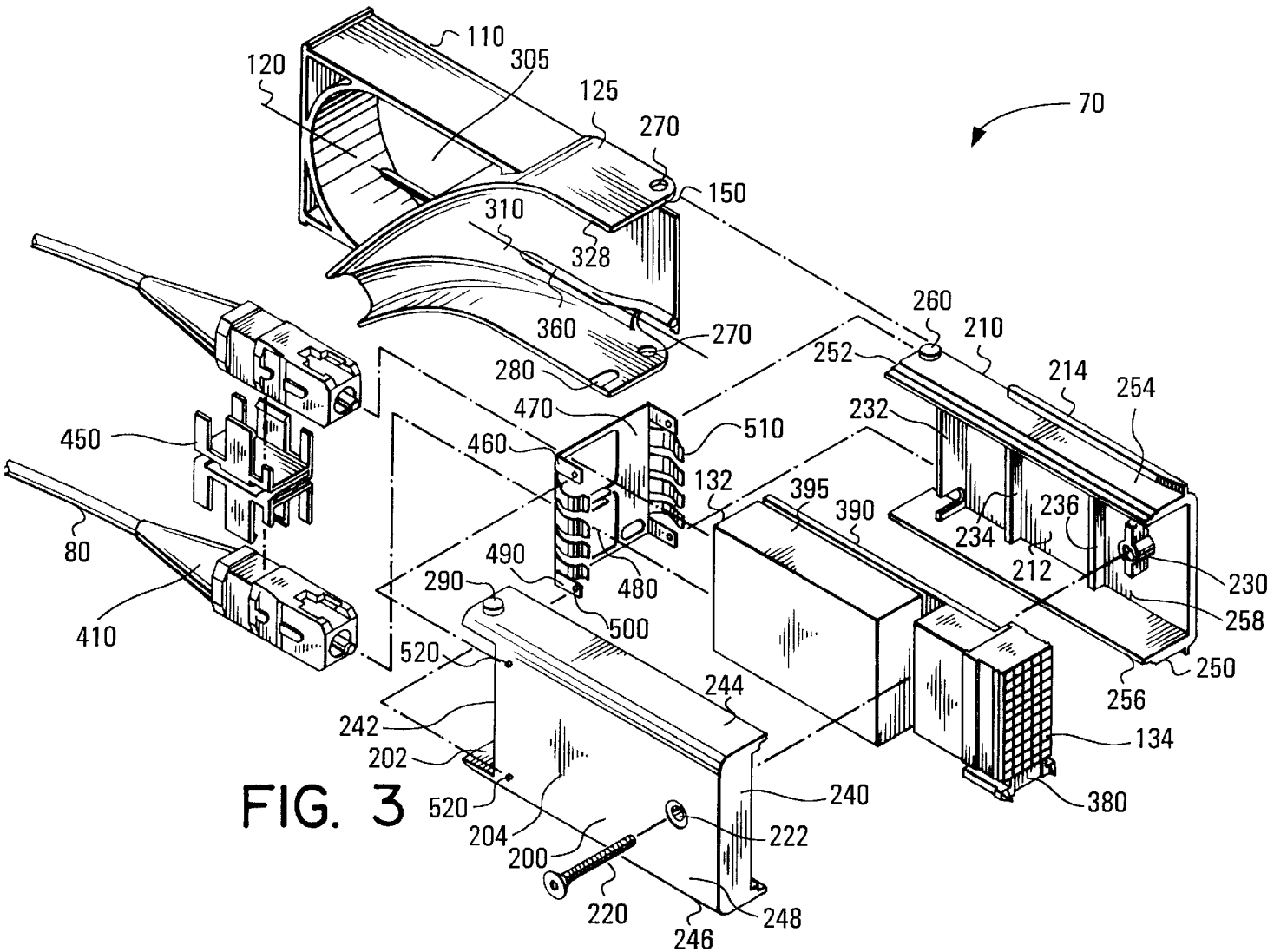
FIG. 3 is an exploded perspective view, drawn to a smaller scale, of the connector assembly shown in FIG. 2.
Figure 8:
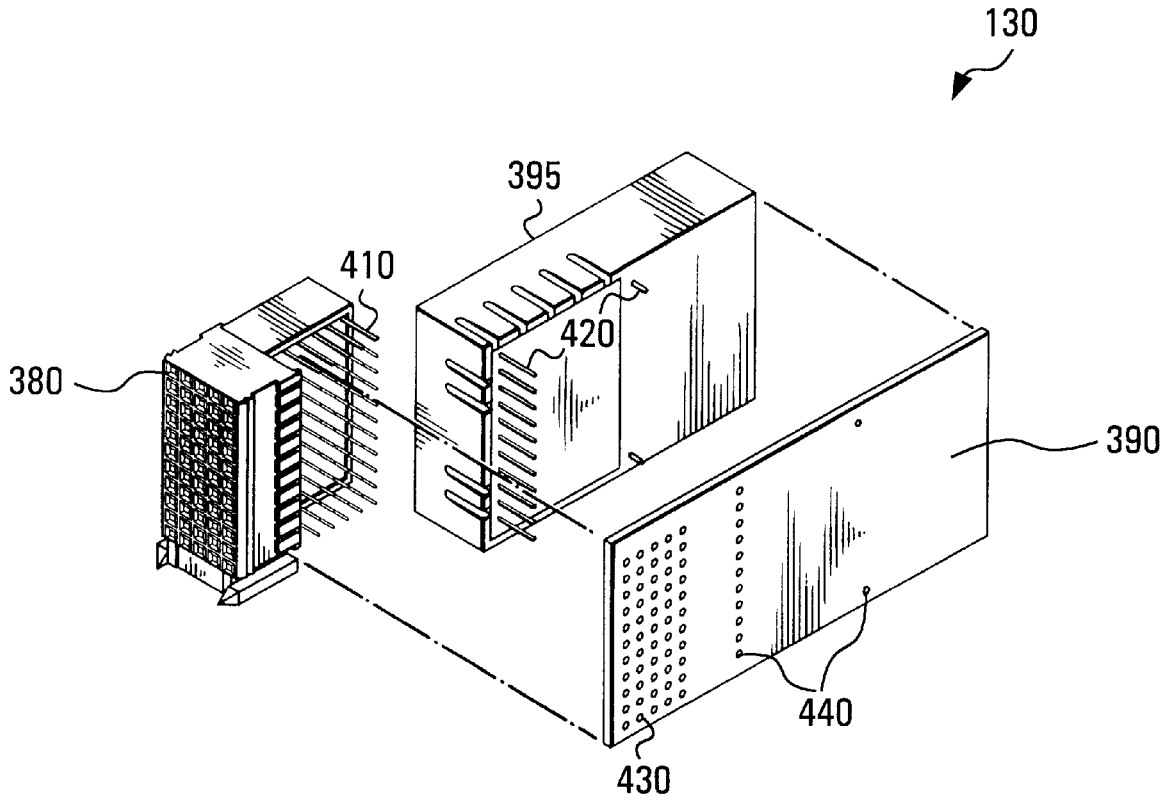
FIG. 8 is an exploded perspective view of a connector sub-assembly forming part of the connector assembly of FIG. 3.

Referring to FIGS. 3 and 8, the connector sub-assembly 130 comprises a module mating connector 380 for mating the module connector 90, a circuit board 390 having a hole (not shown) for receiving the bolt 220 and an electronics sub-module 395 having two cable mating connectors 400 for mating with the cable connectors 410 respectively attached to the cables 80. The module mating connector 380 and the electronics sub-module 395 are connected to the circuit board 390 with the cable mating connectors 400 disposed at the rear end 132 and the module mating connector 380 disposed at the front end 134 of the connector sub-assembly 130. The module mating connector 380 and the cable mating connectors 400 are substantially aligned and define a longitudinal axis 120. The electronics sub-module 395 is typically a fibre optic transceiver which converts the fibre optic signals into electrical signals. In particular, a plurality of connector pins 410 attached to the module mating connector 380 and a plurality of connector pins 420 connected to the electronics sub-module 395 pass through a first set of holes 430 and a second set of holes 440 respectively in the circuit board 390. The connector pins 410 and 420 are typically soldered to the circuit board 390. The circuit board 390 provides a connection or more typically a plurality of connections between the module mating connector 380 and the electronics sub-module 395. In other words, the module mating connector 380 and the cable mating connectors 400 are indirectly electrically interconnected to each other.

Referring to FIGS. 2 and 3, the majority of the connector sub-assembly 130 is placed inside the body portion 100 with a portion of the module mating connector 380 typically outside the body portion 100. In particular, to protect the connector pins 410 and the connector pins 420, the circuit board rests on the first, second and third ridges (232, 234 and 236). The ridges 232, 234 and 236 are located on the inside 212 of the side 258 of the body portion 100 where the connector pins 410 and 420 will no touch the ridges 232, 234 and 236. The ridges 232, 234, and 236 also help prevent the connector sub-assembly 130 from moving in relation to the body portion 100.

Figure 4:
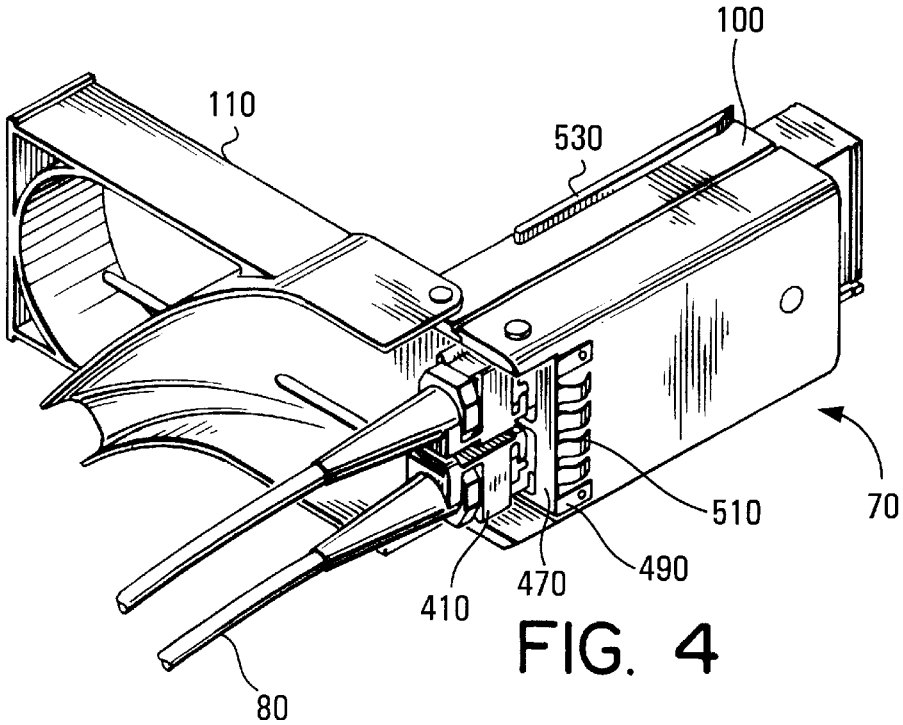
FIG. 4 is a perspective view, of the connector assembly, shown in FIG. 2, in which the cable guide portion is shown in an open position and the cable connectors are shown in the mated position.
Figure 5:
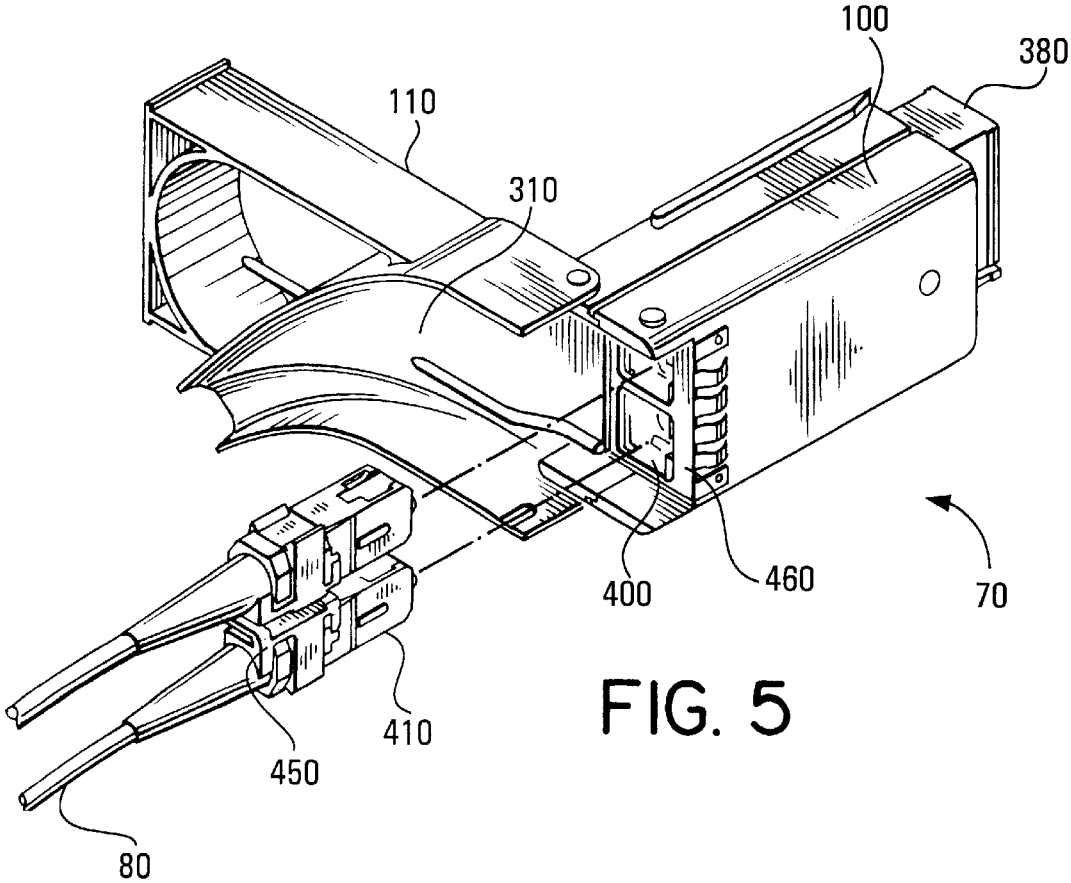
FIG. 5 is a perspective view of the connector assembly, shown in FIG. 2, in which the cable guide portion is shown in the open position and the cable connectors are shown in an unmated position.

Referring to FIGS. 3, 4 and 5, the body portion 100 may also further comprise a ground shield 460. The ground shield 460 typically comprises a base 470 having at least one hole 480 for receiving the at least one cable connector 410, a plurality of attachment legs 490 perpendicular to the base 470, each attachment leg having a hole 500 and a plurality of raised legs 510 substantially perpendicular to the base 470.

The ground shield 460 is placed over the rear end 242 of the first half 200 and the rear end 252 of the second half 210 of the body portion 100. The holes 500 mate with a plurality of pins 520 attached to the outside 204 of the side 248 near the rear end 242 and the outside 214 of the side 258 near the rear end 252 of the body portion 100.

The cable connectors 410 may be placed in a fixed relationship to each other by an optional fastener 450.

Referring to FIGS. 2, 3, 4 and 5, the cable guide portion 120 is connected to the body portion 100 by a pivotal connection. In this embodiment the pivotal connection comprises a first pair of pins 260 attached to the body portion 100 which mate with a pair of holes 270 in the handle portion 110. The first pair of pins 260 are located on the top 254 and the bottom 256 respectively of the second half 210 near the rear end 252. The pair of holes 270 are located on the top wall 322 and the bottom wall 324 respectively of the cable guide portion 125 near the front end 150 and near the back 326.

The pivotal connection permits movement of the cable guide portion 125 relative to the body portion 100 between a closed position (shown in FIG. 2) in which the body portion 100 and the cable guide portion 125 are aligned with each other and an open position (shown in FIGS. 4 and 5) in which the cable guide portion 125 is perpendicular or substantially perpendicular to the body portion 100.

In the closed position, a pair of grooves 280 on the cable guide portion 125 mate with a second pair of pins 290 attached to the body portion 100. The second pair of pins 290 are located on the top 244 and the bottom 246 respectively of the first half 200 of the body portion 100 near the rear end 242. The pair of grooves 280 are located on the top wall 322 and the bottom wall 324 respectively of the cable guide portion 125 near the front end 150 and near the front side 328.

The cable guide portion 125 is made from a resilient material (such as ABS plastic) permitting the pair of holes 270 to be placed over the first pair of pins 260 and permitting the pair of grooves 280 to be placed over a second pair of pins 290.

If it is not possible to place the cable guide portion 125 in an open position due to nearby obstructions, such as a wall, nearby connector assemblies, etc., it may be possible to avoid the obstructions by completely removing the cable portion 125 from the body portion 100, by rotating the cable guide portion 125 180° around the longitudinal axis 120 and by pivotally connecting the cable guide portion 125 to the body portion 100. In particular, the pair of holes 270 are placed over the second pair of pins 290. In the closed position, the pair of grooves 280 mate with the first pair of pins 260.

The cable guide 310 guides the cables 80 in a direction away from the longitudinal axis 120. In other words, the curved top wall 332, the curved bottom wall 334 and the curved back 336 all converge toward the cable opening 350 having a second longitudinal axis away from the longitudinal axis 120.

Referring to FIGS. 4 and 5, the open position of the cable guide portion 125 permits access to manually mate or unmate the cable connector 410 with the cable mating connector 400. Referring to FIG. 2, the closed position of the cable guide portion 125 prevents such access. The handle portion 110 facilitates the movement of the cable guide portion 125 relative to the body portion 100 between the closed position and the open position and vice-versa.

Referring to FIG. 1, the handle portion 110 facilitates movement of the connector assembly 70 between a connected position in which the module mating connector 380 is mated with the module connector 90 and a disconnected position in which the module mating connector 380 and the module connector 90 are disconnected from each other. The disconnected position permits freedom of movement of the connector assembly 70 into and out from the opening 60 and towards and away from the module 10.

In particular, when the cable guide portion 125 is in the closed position, the handle portion 110 facilitates movement of the connector assembly 130 between the connected position and the disconnected position. In the connected position, the ground shield 480 typically mates with the opening 60 to help ensure that the connector assembly 70 is grounded.

Referring to FIGS. 1 and 2, connector assembly alignment means is typically provided to control movement of the connector assembly 70 to ensure straight line action of a module mating connector 380 when mating it with and disconnecting it from the module connector 90. The connector assembly alignment means is typically provided by cooperative alignment elements provided upon the connector assembly 70 and the opening 60. In the preferred embodiment, the alignment elements are provided by a fourth ridge 530 and a fifth ridge 540 on the top 254 and the bottom 256 respectively of the outside 214 of the second half 210 of the body portion 100. The fourth ridge 530 and the fifth ridge 540 run parallel to the side 258. Two complementary grooves (not shown) are provided in the opening 60 to receive the fourth ridge 530 and the fifth ridge 540.

Module connector alignment means may also be provided to ensure proper mating of the module connector 90 and the module mating connector 380.

Figure 6:
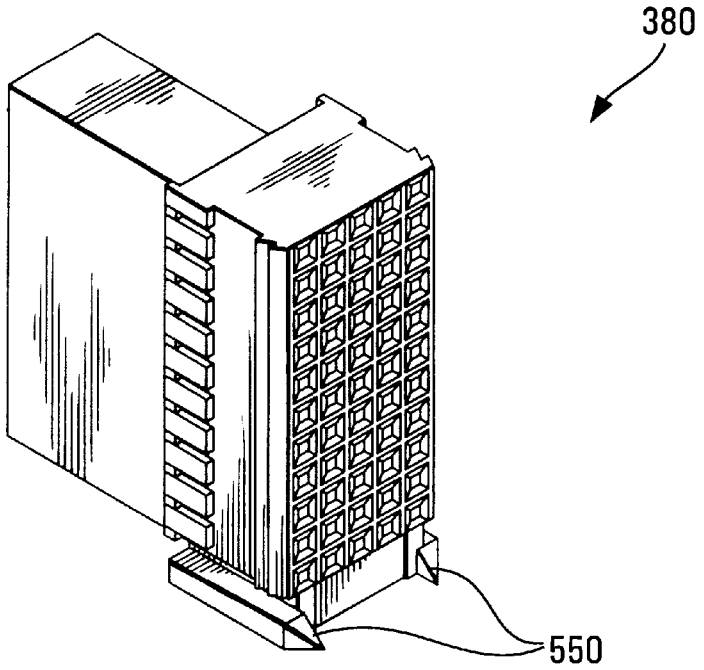
FIG. 6 is a perspective view, drawn to a larger scale, of a module mating connector used in the connector assembly of FIG. 2.
Figure 7:
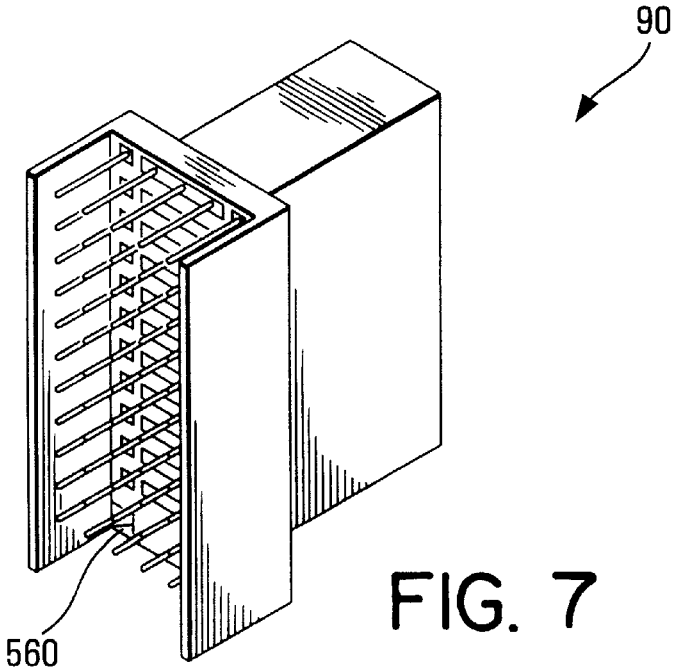
FIG. 7 is a perspective view, drawn to a larger scale, of a module connector shown in FIG. 1.

Referring to FIG. 6 and 7, the module connector alignment means is typically provided by cooperative alignment elements provided on the module connector 90 and the module mating connector 380. In the preferred embodiment, the alignment elements were provided by two pins 550 on the module mating connector 380 and two holes 560 on the module connector 90 for receiving the two pins 550.

Other variations of the invention are possible. For example, there may be only one cable 80 with a cable connector 410 and a connector assembly with only one cable mating connector 400. The cable connector 410 mates with the cable mating connector 400. Alternatively, there may be a plurality of cables 80, each with a respective cable connector 410. Similarly, the connector assembly 70 has a plurality of cable mating connectors 400 for mating with the cable connectors 410 respectively.

Another variation is possible. The connector assembly 70 may have a plurality of module mating connectors 380, each mounted to the circuit board 390. The plurality of module mating connectors mate with a plurality of module connectors 90 respectively placed inside the opening 60 at locations spaced back from the front edge 20.

Yet other variations of the invention is possible. The electronics sub-module 395 need not be a fibre optic transceiver. Depending on the application, the electronics sub-module 395 can be virtually any electrical, electronic, optical, etc. module, such as an amplifier, etc. Furthermore, depending on the application, the electronics sub-module may be eliminated altogether. The module mating connector 380 (or module mating connectors 380) and the cable mating connectors 410 can be simply mounted to the circuit board 390. Alternatively, the circuit board 390 can be eliminated and the module mating connector 380 (or module mating connectors 380) can be directly connected to the cable mating connectors 410.

Another variation of the invention is possible. The cable guide portion 125 may be simply attached in fixed relation to the body portion 100. (i.e. there is no pivotal connection).

Another variation is possible. The handle portion 110 may be eliminated altogether. The cable guide portion 125 may function as a crude handle.

All such variations are believed to be within the sphere and scope of the invention.

We claim:

1. A connector assembly for releasably interconnecting at least one cable connector connected to a respective cable to at least one module connector attached to a module, the connector assembly comprising a body portion and a cable guide portion, wherein the body portion has a front end and an opposite second end and is provided with at least one module mating connector at the front end for releasably mating with the at least one module connector and at least one cable mating connector at the second end for releasably mating with the at least one cable connector, the module mating connector and the cable mating connector being mutually electrically interconnected and wherein the cable guide portion is disposed at the second end of the body portion and comprises a cable guide for guiding the respective cable of the cable connector in a predetermined direction and in a manner to prevent the breakage of the respective cable due to excessive bending of the respective cable, the cable guide portion being pivotally connected to the body portion to permit movement of the cable guide portion between an open position relative to the body portion in which open access to manually mate or unmate the cable connector with the cable mating connector is provided and a closed position relative to the body portion in which the cable guide prevents such access, the cable guide being operational for guiding the respective cable in the predetermined direction only when the cable guide is in the closed position.

2. A connector assembly according to claim 1 wherein the cable mating connector and the module mating connector are substantially aligned and defining a longitudinal axis and wherein the cable guide guides the respective cable away from the longitudinal axis.

3. A connector assembly according to claim 3 wherein the cable guide comprises:

a curved back;

a curved top attached to the curved back; and, a curved bottom attached to the curved back;

wherein the curved top, the curved bottom and the curved back all converge toward a cable opening away from the longitudinal axis to receive the respective cable;

and wherein the respective cable has a breakage radius at which the respective cable will likely break;

and wherein the arcs of the curved top, the curved bottom and the curved back are each greater than the breakage radius.

4. A connector assembly according to claim 3 wherein there is more than one respective cable and wherein the cable guide comprises a cable divider attached to the curved back to separate the respective cables.

5. A connector assembly according to claim 4 further comprising a handle portion attached to the cable guide portion wherein the handle portion facilitates movement of the cable guide portion between the open position and the closed position and vice-versa and facilitates movement of the connector assembly between a connected position in which the module mating connector is mated with the module connector and a disconnected position in which the module mating connector is disconnected from the module connector and vice-versa.

6. A cable assembly according to claim 5 wherein the handle portion comprises:

a top wall attached to the cable guide portion;

a bottom wall attached to the cable guide portion;

a front outside wall connected to the top wall and to the bottom wall; and a concave front inside wall connected to the front outside wall, to the top wall and to the bottom wall;

wherein the top wall, the bottom wall and the curved front inside wall form an opening to facilitate the movement of the connector assembly between the open and closed position and between the connected position and the disconnected position.

7. A connector assembly according to claim 6 wherein the connector assembly and the module have cooperative alignment elements to facilitate the alignment of a plurality of terminals of the module connector and the module mating connector, the cooperative element elements providing a means to facilitate a straight line action of the connector assembly.

8. A connector assembly according to claim 7 wherein the one module connector and the module mating connector have cooperative alignment elements to facilitate the alignment of the terminals of the at least one module connector and the at least one module mating connector.

9. A connector assembly according to claim 8 wherein an electronics sub-module is connected directly or indirectly to the cable mating connector and to the module mating connector.

10. A connector assembly according to claim 9 wherein the electronics sub-module is a fibre optic transceiver.

11. A connector assembly according to claim 10 wherein there are one module mating connector and two cable mating connectors.

12. A connector assembly for releasably interconnecting at least one cable connector connected to a respective cable to at least one module connector attached to a module, the connector assembly comprising a body portion and a cable guide portion, wherein the body portion has a front end and an opposite second end and is provided with at least one module mating connector at the front end for releasable mating with the at least one module connector and at least one cable mating connector at the second end for releasably mating with the at least one cable connector, the module mating connector and the cable mating connector being mutually electrically interconnected and wherein the cable guide portion is disposed at the second end of the body portion and comprises a cable guide for guiding the respective cable of the cable connector in a predetermined direction and in a manner to prevent the breakage of the respective cable due to excessive bending of the respective cable, the cable guide portion being connected to the body portion.

13. A connector assembly according to claim 12 wherein the cable mating connector and the module mating connector are substantially aligned and defining a longitudinal axis and wherein the cable guide guides the respective cable away from the longitudinal axis.

14. A connector assembly according to claim 13 wherein the cable guide comprises:

a curved back;

a curved top attached to the curved back; and, a curved bottom attached to the curved back;

wherein the curved top, the curved bottom and the curved back all converge toward a cable opening away from the longitudinal axis to receive the respective cable;

and wherein the respective cable has a breakage radius at which the respective cable will likely break;

and wherein the arcs of the curved top, the curved bottom and the curved back are each greater than the breakage radius.

15. A connector assembly according to claim 14 wherein there is more than one respective cable and wherein the cable guide comprises a cable divider attached to the curved back to separate the respective cables.

16. A connector assembly according to claim 15 further comprising a handle portion attached to the cable guide portion wherein the handle portion facilitates movement of the connector assembly between a connected position in which the module mating connector is mated with the module connector and a disconnected position in which the module mating connector is disconnected from the module connector and vice-versa.

17. A cable assembly according to claim 16 wherein the handle portion comprises:

a top wall attached to the cable guide portion;

a bottom wall attached to the cable guide portion;

a front outside wall connected to the top wall and to the bottom wall; and a concave front inside wall connected to the front outside wall, to the top wall and to the bottom wall;

wherein the top wall, the bottom wall and the curved front inside wall form an opening to facilitate the movement of the connector assembly between the connected position and the disconnected position.

18. A connector assembly according to claim 17 wherein the connector assembly and the module have cooperative alignment elements to facilitate the alignment of a plurality of terminals of the module connector and the module mating connector, the cooperative element elements providing a means to facilitate a straight line action of the connector assembly.

19. A connector assembly according to claim 18 wherein the one module connector and the module mating connector have cooperative alignment elements to facilitate the alignment of the terminals of the at least one module connector and the at least one module mating connector.

20. A connector assembly according to claim 19 wherein an electronics sub-module is connected directly or indirectly to the cable mating connector and to the module mating connector.

21. A connector assembly according to claim 20 wherein the electronics sub-module is a fibre optic transceiver.

22. A connector assembly according to claim 21 wherein there are one module mating connector and two cable mating connectors.

* * * * *